United States Patent [19]

Kurzinski

[11] Patent Number: 4,669,525

[45] Date of Patent: Jun. 2, 1987

[54] SYSTEM FOR OSCILLATING MOLD TUBE IN CONTINUOUS CASTING APPARATUS

[75] Inventor: Cass R. Kurzinski, Syracuse, N.Y.

[73] Assignee: AMB Technology, Inc., Syracuse, N.Y.

[21] Appl. No.: 803,058

[22] PCT Filed: Mar. 29, 1984

[86] PCT No.: PCT/US84/00410

§ 371 Date: Nov. 19, 1985

§ 102(e) Date: Nov. 19, 1985

[87] PCT Pub. No.: WO85/04125

PCT Pub. Date: Sep. 26, 1985

[51] Int. Cl.[4] ..... B22D 11/04

[52] U.S. Cl. ..... 164/416; 164/478

[58] Field of Search ..... 164/416, 478

[56] References Cited

U.S. PATENT DOCUMENTS

| | | | |
|---|---|---|---|
| 2,578,213 | 12/1951 | Welblund | 164/416 |
| 3,075,264 | 1/1963 | Wognum | 164/478 X |
| 3,386,494 | 6/1968 | Yearley et al. | 164/416 |
| 4,438,803 | 3/1984 | Takeuchi et al. | 164/478 X |
| 4,483,385 | 11/1984 | Kurzinski | 164/416 |

FOREIGN PATENT DOCUMENTS

| | | | |
|---|---|---|---|
| 47-36614 | 9/1972 | Japan | 164/478 |
| 57-97844 | 6/1982 | Japan | 164/478 |
| 2108878A | 5/1983 | United Kingdom | 164/478 |

OTHER PUBLICATIONS

"Spray-Tech Mold System Boosts Steel Production", in *Iron and Steel Engineer*, vol. 59, No. 7, Pittsburgh, Jul. 1982, pp. 59 and 60.

*Primary Examiner*—Kuang Y. Lin
*Assistant Examiner*—J. Reed Batten, Jr.
*Attorney, Agent, or Firm*—Dennis H. Lambert

[57] ABSTRACT

A mold tube supported in but spaced from a mold housing is vibrated by at least one vibrator connected to the mold tube through a keeper plate.

7 Claims, 3 Drawing Figures

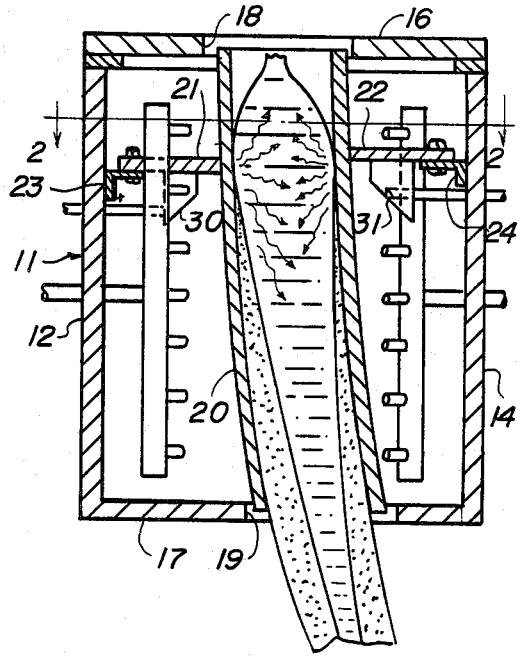

SYSTEM FOR OSCILLATING MOLD TUBE IN CONTINUOUS CASTING APPARATUS

DESCRIPTION

1. Technical Field

This invention relates generally to the casting of metals, and more particularly, to the continuous casting of metals having a high melting point, i.e., above about 2600° F.

In the continuous casting of high temperature metals, it is essential that the cast metal be prevented from adhering to the mold as the cast metal cools and solidifies.

2. Background Art

In conventional continuous steel casting, molten steel is passed throuqh a vertically oriented, usually curved, mold tube. The mold tube is preferably made of copper and typically has a square or rectangular cross-sectional shape. As the molten steel passes through the mold tube its outer shell hardens. As the steel strand continues to harden, it is bent through an angle of 90° so that it moves horizontally upon leaving the casting machine, and it is subsequently cut into individual billets.

The temperature of molten steel is typically 2850° F., although with certain grades of steel the temperature may be as low as 2600° F. In general, although most references herein are to steel casting, the invention contemplates the casting of any metal or metal alloy whose liquid temperature exceeds about 2600° F.

The mold tube is oscillated in conventional continuous casting machines to prevent adherence of the molten metal to the walls of the mold tube. If the oscillation of the mold tube is interrupted or stopped the steel will adhere to the copper mold tube and will eventually form a complete shell surrounding a liquid steel core. When this stationary shell has formed, heat transfer ceases and the strand shell cracks, allowing the liquid steel core to pour out (termed a "break out" in the art). When a break out occurs, the casting operation must cease and the cast steel is ruined.

In addition to oscillation of the mold tube, a lubricating material such as Rapeseed Oil or high melting point powder composition is applied either automatically or manually to the meniscus of the liquid steel in the mold.

Strand oscillation, through research and experimentation conducted during the development of the continuous casting process, was found necessary in order to permit the flow of the lubricating medium onto the walls of the copper mold tube. This lubricating material ensures that the steel will not adhere to the walls of the mold. Heretofore, the most effective frequency and amplitude of the oscillation was believed to be from about 60 to about 120 cycles per minute and from about 0.375 to about 0.750 inch, respectively. Further, the oscillation was rigidly controlled so as to be in the vertical direction only - or parallel to the direction in which the steel strand is moving.

Lateral movement of the mold tube was strictly avoided since it was found that lateral motion caused severe surface cracks on the solidifying steel due to high strand shell stresses arising from this motion. Consequently, large, complex machines were designed and developed to prevent the possibility of any lateral motion of the mold tube during the casting process.

In order to design an oscillating system that will smoothly lift and lower a casting mold requires a very complex mechanical arrangement (a typical casting mold weighs in excess of 1000 pounds). It has, therefore, been very difficult to build a system which ensures that all lateral motion is eliminated. In fact, most oscillators do contain significant lateral motion (as high as 0.625 inch) which, when coupled with an oscillation stroke length in the range of from about 0.375 to about 0.750 inch, results in transverse billet cracks an excessive wear on the copper mold tube. Poor surface quality thus results. All designers and operators of continuous steel casting machines therefore strive to eliminate any form of lateral motion of the mold tube when designing or constructing casting machines.

Since conventional mold oscillation systems require large stroke length, typically 0.375 to 0.750 inch, when lateral motion occurs the strand binds against the copper mold tube walls. Likewise, when the mold moves vertically against the descending strand, the steel abrades a small amount of copper from the mold. This rubbing and abrasion causes the mold to wear. As the lateral motion becomes more pronounced with wear, mold abrasion increases dramatically, thereby requiring the mold to be taken out of service and scrapped. Normally, a copper mold tube is worn out after between about 6,000 to about 10,000 tons of steel have been cast through it.

SUMMARY OF INVENTION

Contrary to the assumption heretofore by designers and operators of continuous casting machines that any movement perpendicular to the casting direction would result in considerable detrimental influence upon the cast strand, it has been found by applicant that a very small amount of high frequency movement in directions both parallel with and perpendicular to the direction of strand movement not only prevents adherence between the steel and mold but also improves the quality of the cast steel strand.

The mold tube is supported by keeper plates mounted to the mold housing. The mold tube is free of any direct contact or connection with mold housing and is movable relative thereto. One or more vibrators are mounted or connected with the keeper plates to cause them to vibrate and thus to cause the mold tube to vibrate. Damper pads are connected between the keeper plates and points of attachment with the mold housing to minimize transfer of vibration to the housing. The vibrators may be commercially available devices to impart a high (1000 to 12000 cycles per minute) frequency, low amplitude (0.00078 to 0.1250 inch) motion to the mold tube.

Since heat transfer from the liquid steel to the cooling water of the continuous casting operation is only effective while the strand shell is in direct contact with the cool copper mold wall, the smallest movement allowable that still permits the uniform flow of lubricating oil along the interface between the steel and the copper mold and continually keeps the cast strand in dynamic relation to the copper mold, will result in a cast structure that is in contact with the mold for longer periods and therefore will exhibit a longer retention time against the cool mold wall. This longer retention time allows for faster and more prolonged heat transfer, thereby resulting in a thicker strand shell and a.more uniform billet structure than is obtainable with a conventional oscillating mold. The improved heat transfer characteristic also results in a significant reduction in billet surface and subsurface cracks. This is because a stronger, thicker strand shell has the tensile strength required to withstand the high stresses experienced when the steel transforms from liquid to solid state. Internal and external cracks are significantly reduced when a strong shell is quickly formed.

The present invention elminates the sticking associated with conventional mold systems and therefore eliminates the corner cracks which are caused by adherence between the metal and mold wall. Further, the solidifying steel skin is subjected to substantially less stress in the high frequency vibrating mold of the invention than it is in conventional low frequency oscillating molds. Surface cracks which form in the steel billets cast by conventional methods may be rolled into the final products of the steel mill, resulting in rejects and scrap. With the present invention, these small surface cracks or oscillation marks do not form. In fact, since the mold is moving at a high frequency relative to the cast strand, the surface is smoothed by the rapid "patting" action of the mold on the strand. The solidifying steel thus exhibits a surface which is as smooth in many cases as the final rolled product. This condition will significantly reduce the cost per ton to produce steel for all mills utilizing the method and apparatus of the invention.

Moreover, as the cast strand solidifies, grains begin to form adjacent the mold wall and nucleate and qrow toward the center of the strand until they ultimately encounter grains growing inwardly from all sides of the strand. At this point, usually from one to fifteen minutes, the strand is solidified. However, since the grains cannot interconnect at the central point, a cavity is formed which can extend the entire length of the strand. This cavity is commonly known as center porosity or looseness. This center porosity is very detrimental to the steel plant since when the final rolling operation is conducted, the looseness will appear as an internal defect, or actually result in the breakage of the rolled piece. Thus, when the products of a conventional caster are rolled to form the finished products of the steel mill, these grains must be continually broken to increase the physical properties of the final products. Strand grain interruption is currently practiced by the use of eIectromagnetic waves which induce a stirring motion in the liquid steel in the mold.

In the present invention, vibration of the mold and thus the metal being cast,induces waves in the metal, travelling throughout the strand and causing the solidification front to be constantly disrupted and fractured. The advancing grains therefore do not form continuous, separate grain fronts, but instead form a series of minute, highly interactive grain fronts that mingle together and fill any voids that tend to form. The result is a strand core that is very dense and free from the detrimental effects of center looseness. Moreover, the grain size throughout the cast strand is smaller and more uniform than is possible with any conventional oscillating mold system.

Still further, with the present invention, the use of high frequency, low amplitude vibration eliminates the need for the large force to lift conventional mold assemblies, and also eliminates the need for guide tables and rollers as required with conventional systems. This permits designers considerable latitude when designing all the supporting systems of the continuous caster, including machine structural members, floor space, load capacities, and total energy required, all of which were heretofore dictated by the limitations imposed by the requirements of conventional mold and oscillator systems. The simplicity of design and elimination of the large machinery, together with the vibration of the mold at high frequency and low amplitude also increases mold life, thereby reducing costs in the production of the cast steel.

BRIEF DESCRIPTION OF THE DRAWINGS

These and other objects and advantages of the invention will become apparent from the following detailed description and accompanying drawings, in which like reference characters designate like parts throughout the several views, and wherein.

BEST MODE FOR CARRYING OUT THE INVENTION

Figure 1:
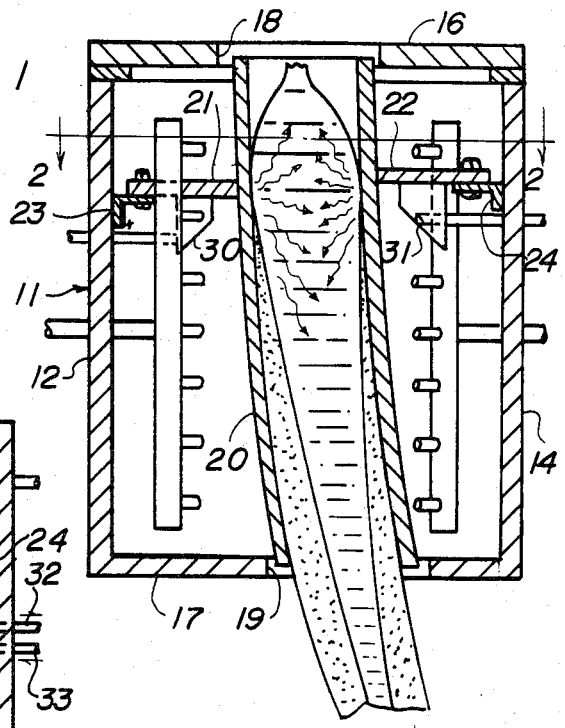
FIG. 1 is a vertical sectional view of a continuous casting mold in accordance with the invention.
Figure 2:
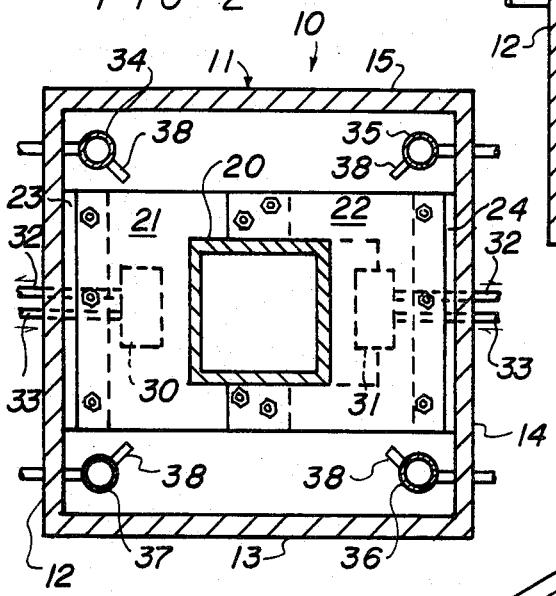
FIG. 2 is a transverse sectional view taken along line 2—2 in FIG. 1.

Referring more specifically to the drawings, an apparatus in accordance with the invention is indicated generally at 10 in FIGS. 1 and 2, and comprises a mold housing 11 having side walls 12, 13, 14 and 15 and top and bottom walls 16 and 17, respectively. The top and bottom walls 16 and 17 have openings 18 and 19 therethrough. The mold housing is supported in the casting machine in a conventional manner, and the supporting structure is not shown in the drawings because this structure is not deemed to constitute a part of the present invention.

An elongate, curved, copper mold tube 20 is supported in the housing with its upper and lower ends aligned with the openings 18 and 19 but spaced from the housing. The mold tube is carried by a pair of substantially flat keeper plates 21 and 22, each having one of their ends bolted or otherwise suitably secured to mounting flanges 23 and 24 welded or otherwise fixed to the housing side walls on opposite sides of the housing. A damper pad 25 is inserted between the end of the keeper plates and associated mounting flange to prevent transfer of vibration from the keeper plates to the mold housing.

Figure 3:
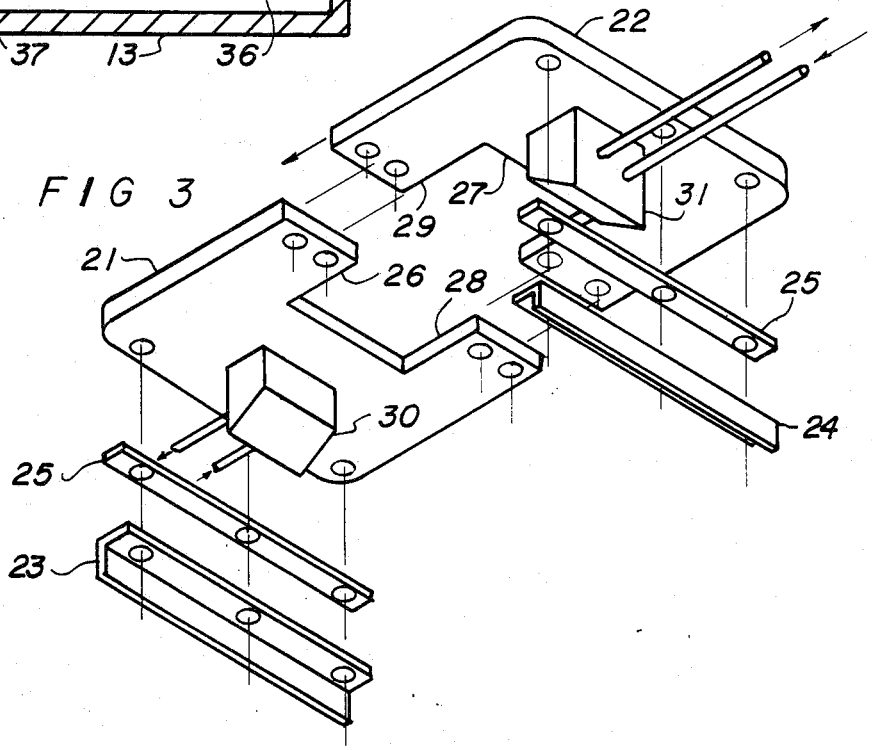
FIG. 3 is an exploded, perspective view, looking from below, of the vibration assembly used in the mold of FIGS. 1 and 2.

As seen best in FIGS. 2 and 3, the other ends of the keeper plates are bifurcated at 26 and 27, defining a yoke-like structure which surrounds the mold tube and includes a pair of legs 28 on one plate which overlap with a corresponding pair of legs 29 on the other keeper plate. The keeper plates are engaged firmly against the outside surface of the mold tube and bolted in place to support the mold tube.

At least one vibrator 30 is mounted on one of the keeper plates, but preferably a second vibrator 31 is also mounted on the other keeper plate as a backup in case of failure of the first vibrator during operation of the system. These vibrators may be of any suitable type, but are preferably pneumatically operated and are commercially available from VIBCO under model number BVS250. Conduits 32 and 33 are connected with each vibrator to supply and exhaust air or other operating fluid to and from the vibrators.

The keeper plates may be positioned at any location along the length of the mold tube within the mold housing, but should be located so as to provide as little interference as possible with the cooling water spray system, described below.

Cooling water is applied to the mold tube exterior surfaces by a spray cooling system including a plurality of upright spray headers 34, 35, 36 and 37 positioned to direct sprays of cooling water against the corners of the mold tube, and each having a plurality of spray nozzles 38 spaced along the length thereof. A suitable spray system is more specifically described in copending application Ser. No. 299,999 and now U.S. Pat. No. 4,494,594.

While the invention has been illustrated and described in detail herein, it is to be understood that various changes in construction and operation can be made without departing from the spirit thereof as defined by the scope of the claims appended hereto.

I claim:

1. Apparatus for continuously casting metal, comprising:

a mold housing having top, bottom and side walls;

a mold tube supported in but spaced from the housing;

keeper plate means engaged with the mold tube and positioned within and fixed to the housing for supporting the mold tube in the housing; and vibration means associated with the keeper plate means for vibrating the keeper plate means and mold tube to prevent adherence of the metal to the mold tube and to reduce solidification time of the metal and enhance internal and external soundness and homogeneity of the cast metal.

2. Apparatus for continuously casting metal as claimed in claim 1, wherein:

the vibration means imparts a vibration to the keeper plate means and mold tube having a frequency in the range of from about 1,000 to about 12,000 cycles per minute and an amplitude in the range of from about 0.00078 to about 0.1250 inch.

3. Apparatus for continuously casting metal as claimed in claim 1, wherein:

the vibration means is mounted to the keeper plate means.

4. Apparatus for continuously casting metal as claimed in claim 3, wherein:

the vibration means is pneumatically operated.

5. Apparatus for continuously casting metal as claimed in claim 4, further comprising:

damper pads interposed between the mold housing and the keeper plate means to minimize transfer of vibration from the keeper plate means to the mold housing.

6. Apparatus for continuously casting metal as claimed in claim 5, wherein:

the keeper plate means comprises a pair of keeper plate with bifurcated ends defining spaced legs extending on opposite sides of the mold tube, said keeper plates firmly contacting and gripping the mold tube on all sides.

7. Apparatus for continuously casting metal as claimed in claim 6, wherein:

the keeper plates are bolted to each other in close-fitting contact with the mold tube.

* * * * *